United States Patent [19]

Fujishige et al.

[11] Patent Number: 4,588,438

[45] Date of Patent: May 13, 1986

[54] MOULDED OBJECT OF ALUMINA MATTER-CONTAINING RAW MATERIAL FOR ALUMINUM SMELTING BY BLAST FURNACE METHOD

[75] Inventors: Masao Fujishige; Masayuki Dokiya; Tetsuya Kameyama; Harumi Yokokawa; Seiichi Ujiie; Kenzo Fukuda, all of Yatabemachi, Japan

[73] Assignee: Agency of Industrial Science and Technology, Tokyo, Japan

[21] Appl. No.: 685,229

[22] Filed: Dec. 27, 1984

Related U.S. Application Data

[62] Division of Ser. No. 523,569, Aug. 16, 1983, abandoned.

[30] Foreign Application Priority Data

Aug. 24, 1982 [JP] Japan ..... 57-146419

[51] Int. Cl.[4] ..... C22B 21/02

[52] U.S. Cl. ..... 75/68 A; 75/124

[58] Field of Search ..... 75/68 A, 124

[56] References Cited

U.S. PATENT DOCUMENTS

| | | | |
|---|---|---|---|
| 3,218,153 | 11/1965 | Schei et al. | 75/3 |
| 3,615,347 | 10/1971 | Schmidt | 75/10 R |
| 4,046,558 | 9/1977 | Das et al. | 75/68 A |
| 4,299,619 | 11/1981 | Cochran et al. | 75/68 A |
| 4,441,920 | 4/1984 | Wilkening | 75/10 R |
| 4,486,229 | 12/1984 | Troup et al. | 75/68 R |

*Primary Examiner*—Melvyn J. Andrews

*Attorney, Agent, or Firm*—Armstrong, Nikaido, Marmelstein & Kubovcik

[57] ABSTRACT

The present invention provides a moulded object of alumina matter-containing raw material for aluminum smelting by a blast furnace method. The moulded object for aluminum smelting is formed by coating a moulded object comprising the alumina matter-containing raw material and a carbon material with carbon material coating layers on its surface.

12 Claims, 2 Drawing Figures

MOULDED OBJECT OF ALUMINA MATTER-CONTAINING RAW MATERIAL FOR ALUMINUM SMELTING BY BLAST FURNACE METHOD

This application is a division, of application Ser. No. 523,569, filed Aug. 16, 1983, now abandoned.

BACKGROUND OF THE INVENTION

The present invention relates to moulded objects of alumina matter-containing raw materials for aluminum smelting by a blast furnace method. Further, alumina matter described in this specification means alumina contained in bauxite or clay, aluminum hydroxide and an alumina component in composite aluminum oxides.

Aluminum is a fundamental metallic material next to iron and its demands are increasing in a high ratio year by year. However, due to an increase in energy cost on a worldwide scale in recent years, aluminum manufacturing in areas such as Japan where electric power cost is high has become very difficult and countries in such areas are incurring serious hindrances to their industrial structure. In addition, areas enabling the locating of a cheap hydro-electric power source therein are expected to be increasingly narrowed in the world hereafter. Therefore, development of an energy-saving and low-cost manufacturing process for the smelting of aluminum that is an important industrial material is being demanded as an urgent problem.

Bayer-Hall-Héroult process that is a conventional aluminum smelting process comprises 1 Bayer process that is a process for extracting alumina from bauxite and 2 Hall-Héroult process that is an electrolytic process. The former process requires extraction and crystallization steps taking a long time so that it has low productivity and results in high equipment cost, and the latter process is an electrolytic process so that it has no merit of plant scaling up, has low productivity and high equipment cost and requires a large amount of electric power. Thus, Bayer-Hall-Héroult process has many industrial demerits as mentioned above and also has already scarcely room for its technical improvement, so that appearance of a drastic new process for aluminum smelting is being demanded.

In order to eliminate such demerits of Bayer-Hall-Héroult process, various alternative smelting processes including an electric furnace reducing process have been studied. However, these processes succeeded neither in energy saving effect nor in a decrease in cost enough to replace the conventional process. As demerits of these alternative processes, there can be cited for example the required electric power similar to or more than that of the conventional process, which is seen in the electric furnace reducing process, and a great amount of energy and much cost that are required for the treatment of raw materials in the electrolytic process of aluminum chloride.

On the other hand, as a method for eliminating the above-mentioned demerits of the conventional aluminum smelting process consuming a lot of electric power, an aluminum smelting process by a blast furnace method for reducing alumina matter-containing raw materials with carbon materials using a blast furnace of counter-current moving bed type has become examined in recent years.

In this process, a packed layer comprising raw materials containing alumina matter and a carbon material acting as a fuel and a reducing agent is formed in a blast furnace and the following combustion reaction (1) and reduction reaction (2) are conducted at the same time in the furnace.

$$C+\tfrac{1}{2}\,O_2 \rightarrow 2\,CO \qquad (1)$$

$$Al_2O_3+3\,C \rightarrow 2\,Al+3\,CO \qquad (2)$$

Reduction of aluminum oxide (alumina matter) represented by Formula (2) is carried out by employing the heat of oxygen combustion of the carbon materials represented by Formula (1) as a heat source for the reduction reaction. Further, the blast furnace is of counter-current moving bed type. At the same time oxygen gas is blown into the furnace at its lower part, a reduction product is taken out of the bottom part of the furnace. Corresponding to the discharge of product, feed raw materials are charged into the furnace through its top, and thus the whole packed layer transfers downward being in counter-current contact with the combustion gas.

When the above-mentioned reactions (1) and (2) are carried out at the same time in a blast furnace to smelt aluminum by a blast furnace method, there are existing various technical problems to be solved for the economical efficiency and workability of the method. In particular, there can be cited the problem of blockade of the furnace and a lowering in aluminum yield that is caused by the evolution and condensation of volatile aluminum components ($Al_2O$ and Al) and a volatile silicon component (SiO).

To restrain the evolution of such volatile aluminum components and of such a volatile silicon component, an alloyable component such as iron or the like is ordinarily added to alumina matter-containing raw materials to lower the reducing temperature for alumina. Thus, there has been adopted a method for improving the formation of metallic aluminum by the above-mentioned addition of an alloyable component to lower the reduction reaction temperature and also to stabilize the formed metallic aluminum by transforming it into an alloy. However, it is difficult to restrain completely the evolution of such volatile substances even by such a method.

In addition, in such a blast furnace method, there is also known a process for feeding alumina matter-containing raw materials into a blast furnace in the form of massive ores comprising the raw materials and a carbon material for the purpose of improving the contact between the reducing agent and alumina matter to raise the rate of reduction reaction or of effectively utilizing powdered raw materials and coke.

However, the process for feeding the raw materials into a blast furnace in the form of massive ores as mentioned above scarcely had the effect of restraining the evolution of the above-mentioned volatile substances and also had the defect of causing a slagging agent for liquating out ash matter contained in a carbon material for fuel to melt with alumina matter-containing raw materials before the materials were subjected to the reduction reaction and of making the alumina matter-containing raw materials difficult to reduce.

SUMMARY OF THE INVENTION

A first object of the present invention is to provide a moulded object of alumina matter-containing raw materials for aluminum smelting by a blast furnace method that has an aluminum yield improved by preventing the blockade of the furnace caused by the evolution of volatile aluminum components such as $Al_2O$ and Al and of a volatile silicon component such as SiO, and by restraining the evolution of such volatile substances.

A second object of the present invention is to provide a moulded object of alumina matter-containing raw materials for aluminum smelting by a blast furnace method, the moulded object comprising a mixture of the alumina matter-containing raw material and a carbon material and having been coated with carbon matter coating layers on its surface in such a way that the shape of the moulded object is retained until the reaction of alumina matter with a carbon material inside the carbon matter coating film is substantially completed.

A third object of the present invention is to provide the moulded object of alumina matter-containing raw materials for aluminum smelting by a blast furnace method, the carbon matter coating layers of the moulded object being so constructed as to act as a protective layer from oxidation due to combustion gases including oxygen.

A fourth object of the present invention is to provide the moulded object of alumina matter-containing raw materials for aluminum smelting by a blast furnace method, the moulded object having an increased reduction efficiency of the alumina matter-containing raw materials by preventing the raw materials from melting with a slagging agent.

These objects of the present invention are attained by the moulded object of alumina matter-containing raw materials for aluminum smelting by a blast furnace method which moulded object comprises the raw material and a carbon material and has been coated with carbon matter coating layers on its surface.

DETAILED DESCRIPTION OF THE INVENTION

Figure 1:
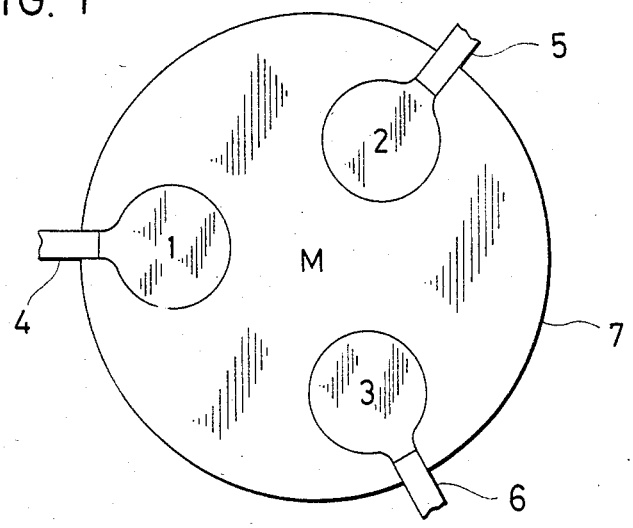
FIGS. 1 and 2 are cross-sectional descriptive diagrams of raceways formed in a blast furnace, FIG. 1 showing the case where raceways do not lap over at all, and FIG. 2 the case where raceways lap over each other.

The present invention provides the moulded object of alumina matter-containing raw materials for aluminum smelting by a blast furnace method which moulded object comprises the raw material and a carbon material and has been coated with carbon matter coating layers on its surface.

As alumina matter-containing raw materials in the moulded object of the present invention, there can be used an extensive range of raw materials, different from the range of raw materials for the electrolytic smelting process, and bauxite having a high content of alumina matter, alum shale, fly ash, bottom ash and the like having a low content of alumina matter can be used as a raw material in the present invention.

As carbon materials used as a reducing agent for the alumina matter, carbon itself such as coal, coke or char coal and carbides such as $Al_4C_4$, SiC, FeC and the like can be used.

In the present invention, the total amount of a carbon material contained in the moulded object comprising an alumina matter-containing raw material and a carbon material and in the surface coating layer with which the moulded object is coated on its surface may be its stoichiometric amount or more and is usually 2 to 5 times its stoichiometric amount, based on the amount of the alumina matter-containing raw material used.

Further, the above-mentioned alumina matter-containing raw materials are used in the form of powder having a particle size usually of 5 mm or less, preferably of 1 mm or less. Carbon materials are used in the form of powder having a particle size usually of 10 mm or less, preferably of 2 mm or less.

In the present invention, first an alumina matter-containing raw material is mixed with a carbon material and then the mixture is moulded. In this process, an appropriate auxiliary component can be added to the mixture. Although the above-mentioned reduction reaction (2) for alumina matter requires a temperature as high as 2100° C., the addition of a component such as iron or silicon to the raw material can lower the reducing temperature to about 1900° C. The inventors carried out many investigations on an iron content in the raw material, and, as a result, found that increasing the content of iron component in the raw material was very effective to a lowering in the above-mentioned reducing temperature and also to the substantial restraint of evolution of volatile components such as $Al_2O$, SiO and the like which evolution was represented by the following reaction formulae (3) and (4) and was obstructive to operation of the blast furnace.

$$Al_2O_3+2\,C \text{ --- } Al_2O+2\,CO \quad (3)$$

$$SiO_2+C \text{ --- } SiO+CO \quad (4)$$

For the effective restraint of evolution of the above-mentioned volatile components, it is preferable that the respective ratios of iron component to aluminum component and to silicon component contained in a raw material are at least a fixed value. It was confirmed that the atomic ratio of Fe/Al was at least 1/7, preferably at least ¼ and the atomic ratio of Fe/Si was at least 1, preferably at least 2.

To obtain the moulded object of the present invention, first the above-mentioned alumina matter-containing raw material, a carbon material and, if necessary, an auxiliary component are mixed and kneaded in the presence of a binder. As the binder, moisture, a carbohydrate such as gum arabic or avicel, a heavy hydrocarbon such as pitch or asphalt or other arbitrary adherent substance is used, and the amount of a binder used is about 1–5% by weight, based on the amount of the mixture. The kneaded mixture (pasty) is moulded into an appropriate shape, namely, a necessary shape such as granular, spherical, bricky, rodlike or cylindrical shape, and then the moulded object is heated to 100°–200° C. to dry and further, if necessary, is burned.

In the present invention, the thus obtained moulded object is, next, coated with carbon matter coating layers on its surface. As a carbon material for the coating layer, coke, coal, char coal or the like is used. The pulverized carbon material (having a particle size of below 10 meshes, preferably below 20 meshes) is blended with a binder such as a liquid hydrocarbon for example coal tar or asphalt or a carbohydrate for example gum arabic or avicel and then the mixture is kneaded to form a pasty carbon material. The above-mentioned moulded object comprising an alumina matter-containing raw material and a carbon material is coated with the pasty carbon material on its surface, and then dried and burned. The burning temperature is 400°–1000° C., preferably 700°–900° C. By this burning, carbon material coating layers rigidly bonded to the surface of the moulded object are formed, and further the strength of the whole moulded object is increased. In addition, in the coating layers, fine pores are formed due to volatile components vaporized and run through the coating in the burning process.

As another method for coating the moulded object with carbon material coating layers on its surface, precursors of carbon materials such as pitch, asphalt and the like can be used in place of the above-mentioned carbon materials. Since pitch and asphalt are molten by heat, the moulded object is coated with the molten liquid of pitch or asphalt on its surface by dipping it into the molten pitch or asphalt, and then is dried and burned. Pitch or asphalt adhering to the surface of the moulded object is coked (carbonized) by the burning process. The burning temperature should be above a temperature at which precursors of carbon materials are coked and it is usually 400°–1300° C., preferably 700°–900° C.

Thus, a product of the moulded object comprising an alumina matter-containing raw material and a carbon material and also having been coated with carbon material coating layers on its surface is obtained. The thickness of the carbon material coating layer is usually 0.5 to 10 mm, preferably 2–5 mm.

The moulded object of alumina matter-containing raw material made in accordance with the present invention is fed into a blast furnace heated to a high temperature by combustion of a fuel and is reacted by an ordinary method.

For carrying out aluminum smelting using the moulded object of alumina matter-containing raw material made in accordance with the present invention, first a blast furnace is filled with a carbon material (fuel), oxygen gas is blown into the furnace and the carbon material is burned to preheat the furnace sufficiently. Next, the moulded object of alumina matter-containing raw material made in accordance with the present invention is fed into the furnace through its top. In this process, the moulded object can be fed in the form of its mixture with the carbon material for fuel, and also the moulded object and the carbon material for fuel can be fed alternatively in such a way that a prescribed amount of the moulded object is first fed and subsequently a prescribed amount of the carbon material is fed and then the feeding method for the moulded object and carbon material is repeated.

Further, if necessary, when the carbon material for fuel is fed, it can be fed in combination with a readily melting material (slagging agent), that is, in the form of a mixture of it with the material (slagging agent) or in such a way that its layer is followed by the layer of a readily melting material (slagging agent). As the material (slagging agent), a subtance that can slag silica and alumina contained in a carbon material, for example, a mineral such as lime stone that contains a calcia component, a mineral such as dolomite that contains a magnesia component or iron blast furnace slag that is an industrial waste can be used.

Figure 2:
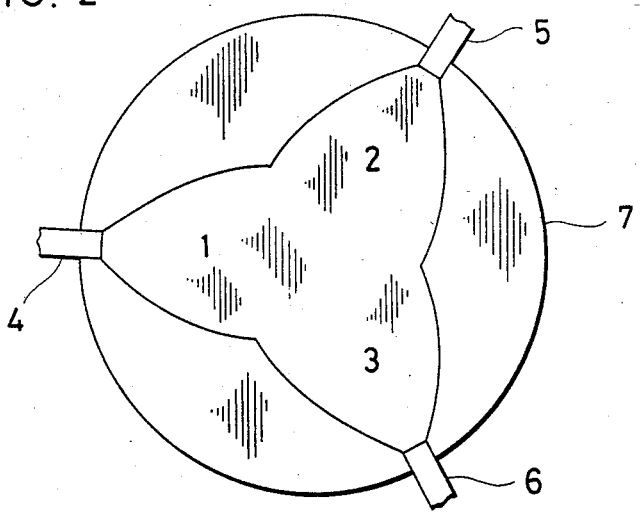

When oxygen gas is blown into a blast furnace through a plurality of lances, two kinds of raceways can be formed by controlling the linear velocity of oxygen supplied. In one case, raceways are independent from each other and do not lap over at all, so that a reducing region is formed between raceways, and in the other case, raceways lap over each other, so that a reducing region is not formed between raceways. The former raceways can be formed by lowering the linear velocity of oxygen gas supplied and the latter ones by increasing the linear velocity of oxygen gas supplied. FIG. 1 shows a cross-sectional descriptive diagram for the former raceways in the case where raceways do not lap over at all and a reducing region is formed, and FIG. 2 the same diagram for the latter raceways in the case where raceways lap over each other so that no reducing region is formed. In FIGS. 1 and 2, the numeral 7 shows the furnace wall, numerals 4, 5 and 6 oxygen lances, numerals 1, 2 and 3 raceways and M the reducing region. Further, a raceway means a combustion region formed in packed layers when oxygen gas for combustion is blown into packed layers with carbon materials to burn the carbon materials and flames due to the combustion of carbon materials are present in the combustion region. The raceway forms the maximum temperature region in a reaction furnace and also is an oxidizing region because it is a place into which oxygen is supplied. On the other hand, the part M isolated from raceways has a low temperature as compared with raceway parts and forms a reducing region because no oxygen is supplied into it.

It has been ascertained that when the moulded object of alumina matter-containing raw materials is fed by a gravity-fall method, it falls mainly in a raceway region. The raceway region has a temperature (of 2200°–2700° C.) much higher than a temperature range of 1900°–2200° C. required for the reduction of alumina, and a high oxygen partial pressure because oxygen gas for combustion is being supplied into it, and also has very fast gas velocity because it is near a tuyere. Thus, the raceway region forms an oxidizing region.

With the conventional moulded object comprising an alumina matter-containing raw material and a carbon material and without carbon material coating layer on its surface, the reaction of the conventional moulded object occurs in the raceway and the alumina matter-containing raw material is once reduced. However, the reduced product partially reacts with oxygen to form volatile $Al_2O$ gas and partially becomes aluminum vapor. Further, since partial pressures for $Al_2O$ gas and Al vapor in this region become higher than in other regions having a lower temperature than has this region and further $Al_2O$ gas and Al vapor formed are transported to the top part of furnace by fast gas flow from the raceway to the top part, the evolution of $Al_2O$ gas and Al vapor is further accelerated. Therefore, most of aluminum component supplied is transported upward as volatile substances.

$Al_2O$ gas and Al vapor thus transported to the top part of furnace are cooled there and simultaneously these react with CO to form alumina, which forms shelf-shaped secured deposits between the furnace wall and packed layers and causes the blockade of furnace, and also are partially exhausted to the outside. The above-mentioned reaction of the conventional moulded object of alumina matter-containing raw material in the raceway region eventually causes a marked lowering in the yield of reduced aluminum or an aluminum alloy.

Further, also with respect to silica matter contained in alumina raw materials, a reaction similar to the above-mentioned reaction of alumina in the raceway occurs.

In contrast to the above, the moulded object comprising an alumina matter-containing raw material and a carbon material and having been coated with carbon material coating layers on its surface in accordance with the present invention is scarcely fractured in the raceway and can retain its shape until the reaction of the alumina matter-containing raw material with the carbon material inside the coating layers is substantially completed. In addition, the carbon material coating layers provide an action to protect the reaction of the alumina matter-containing raw material with the carbon material inside the coating layers from a high-temperature oxidizing atmosphere in the raceway, so that the transportation of Al vapor, $Al_2O$ gas and SiO vapor to the top of furnace by a gas flow is prevented and problems of the blockade of furnace and of a lowering in the aluminum yield are markedly improved, different from the case of the conventional moulded object of alumina matter-containing raw material.

In addition, the moulded object comprising an alumina matter-containing raw material and a carbon material and having been coated with carbon matter coating layers on its surface in accordance with the present invention is very effective for preventing the alumina matter-containing raw material from melting with a slagging agent as compared with the conventional moulded object of alumina matter-containing raw material.

In operating a blast furnace, there has been carried out a process of adding about 3% by weight of a slagging agent based on the amount of carbon materials for combustion to liquating out ash matter contained in the carbon material. Further, in the course of research for attaining the present invention, it was found that addition of a large amount, for example, about 20% by weight of a slagging agent based on the amount of carbon materials for fuel was very effective for quick dropping down of crude alloy formed to the bottom part. However, when such a large amount of slagging agent was added, there occurred the difficulty that because the moulded object of alumina matter-containing raw material melted with the slagging agent, the raw material combined with the component of the slagging agent to form a composite oxide and became difficult to reduce.

With the moulded object of alumina matter-containing raw material made in accordance with the present invention, it is possible to prevent the alumina matter-containing raw material from being brought into contact with the slagging agent until the raw material is reduced to form an alloy and the coating layers come to be fractured, so that it becomes possible to form the alloy avoiding the above-mentioned difficulty.

When carrying out aluminum smelting using the moulded object of alumina matter-containing raw material made in accordance with the present invention, feeding of a mixed gas of oxygen and carbon dioxide into a furnace is advantageous for elevating the effect of the invention. When such a mixed gas is fed, it is possible to lower the temperature of the raceway part from a temperature of 2200°–2700° C. when carbon dioxide is not mixed down to a temperature of 2000° C. level required for the reaction of the raw material with the carbon material and also to prevent the formation and vaporization loss of volatile components. It is also possible to use nitrogen gas or steam in place of carbon dioxide.

In addition, for the prevention of the vaporization loss, it is also effective to feed the moulded object of alumina matter-containing raw material made in accordance with the present invention and the above-mentioned readily melting material (slagging agent) into a furnace at the same time. When the moulded object and a readily melting material (slagging agent) are used at the same time, after reaction of the raw material with the carbon material has been substantially completed, the moulded object is fractured naturally and an aluminum component formed flows out of the moulded object. At this point of time, the aluminum component formed is mixed with the molten liquid of the readily melting material to form a melt and then the melt is rapidly transported to the outside of furnace. Thus, the vaporization loss of aluminum formed is prevented.

The readily melting material is used in a ratio of the material to the moulded object of alumina matter-containing raw material of 30–2000 parts by weight, preferably 300–700 parts by weight to 1000 parts by weight.

Furthermore, the moulded object of alumina matter-containing raw material made in continuous form such as rodlike form in accordance with the present invention can be fed selectively into the reducing region M shown in FIG. 1 avoiding a substantial contact with raceway parts. Since the reducing region M has a low temperature and low oxygen partial pressure, in this process problems such as the blockade of furnace and the vaporization loss of aluminum formed scarcely occur and very advantageous aluminum smelting by a blast furnace method can be attained.

The following examples describe the present invention in more detail.

EXAMPLE 1: Preparation of Bauxite Moulded Object

A mixture of 1000 parts by weight of bauxite (having a particle size of 20 meshes), 62 parts by weight of iron powder (having a particle size of 20 meshes) and 300 parts by weight of coke (having a particle size of 20 meshes) was blended with an appropriate amount of binder and the mixture was kneaded homogeneously with a kneader. Thereafter, the compound was moulded into a spherical form having a diameter of 20–30 mm and then dried at 200° C. to provide the bauxite moulded object without carbon material coating layers (L). The moulded object (L) was dipped into a coal tar-benzene solution and then the moulded object (L) was coated with pulverized coke (having a particle size of 20 meshes) on its surface. Subsequently, the thus obtained moulded object was heated with gas burners and the volatile components were carbonized while burned. Thus, bauxite moulded objects (A) coated with carbon coating layers (2–5 mm thick) on their surfaces in accordance with the present invention were obtained. Composition examples of the thus obtained moulded object (A) are shown in the following Table 1.

TABLE 1

| Bauxite (Components of molded object L) (kg) | Iron powder (kg) | Coke (kg) | Coating coak (kg) |
|---|---|---|---|
| 1 (particle) | — | 0.3 | 1.151 |
| 1 (particle) | 0.5 | 0.25 | 0.78 |
| 1 (particle) | — | 0.25 | 0.88 |
| 1 (particle) | — | 0.25 | 0.77 |
| 1 (particle) | — | — | 0.5 |

EXAMPLE 2: Aluminum Smelting

A cylindrical reaction furnace having an internal diameter of 36 cm and a furnace height of 80 cm was used to reduce bauxite moulded objects. First coke for fuel (having a particle size of about 4–7 mm) was packed into the lower part of the furnace and then oxygen gas was introduced into the furnace at a feed rate of 100 l/min through three water cooled copper lances arranged symmetrically in the peripheral wall of the lower part of furnace to preheat the reaction furnace sufficiently. Subsequently, a mixture of the above-mentioned bauxite moulded object and coke particles (having a diameter of 4–7 mm) and having a mixing ratio by weight of coke to the bauxite moulded object of 3 to 1 was packed into the furnace through the top of furnace. Thus, the bauxite moulded object was reduced while coke was burned and an aluminum/iron alloy was obtained from the bottom of furnace. The reaction result is shown in Table 2.

TABLE 2

| Type of moulded object | Crude alloy yield per kg of bauxite | Ratio of Al/Fe in crude alloy |
|---|---|---|
| Invention product (A) | 7% | 1/4 |
| Comparative product (L) | 3% | 1/10 |

EXAMPLE 3

The reduction reaction of the bauxite moulded object was carried out by the same method as in EXAMPLE 2 except that $CO_2$ gas was mixed to $O_2$ gas in a mixing ratio by volume of $O_2$ gas/$CO_2$ gas of 1:0.1 and a slagging agent (obtained by moulding of a mixture having a mixing ratio by weight of bauxite to calcium carbonate of 1 to 1) was added to the mixture of the bauxite moulded object and coke in an addition ratio by weight of the slagging agent to the bauxite moulded object of 0.5 to 1. The result is shown in Table 3.

TABLE 3

| Type of moulded object | Crude alloy yield per kg of bauxite | Ratio of Al/Fe in crude alloy |
|---|---|---|
| Invention product (A) | 9% | 1/3 |
| Comparative product (L) | 3% | 1/10 |

What is claimed is:

1. A method of smelting aluminum by a blast furnace method, which comprises the steps of:

A. kneading together powder of an alumina matter-containing raw material, iron, and powder of a carbon material in the presence of a binder, in such an amount so that the atomic ratio for Fe/Al is at least 1/17, and for Fe/Si is at least 1, based on any silicon component present in the alumina matter-containing raw material, so that the evolution of volatile components is restrained molding the kneaded mixture and drying the molded mixture, B. forming on the surface of the molded and dried mixture a layer of a paste of a carbon material and a binder, followed by drying and then baking the resultant surface-treated mixture, to prepare a finished molded object, C. charging fuel coke in a blast furnace, and with an oxygen-containing gas circumferentially introduced into the furnace, burning the fuel coke to produce an oxidizing region within the furnace, while producing a reducing region in the vicinity of the center of the furnace in which combustion of the fuel coke does not take place, D. then supplying said finished molded object from the above step B into said reducing region within the furnace to cause to be reduced the alumina matter-containing raw material present in said finished molded object, and then taking aluminum in the form of an aluminum-iron alloy from a bottom portion of the blast furnace.

2. A method as claimed in claim 1, wherein said alumina matter-containing raw material is bauxite, alum shale, fly ash or bottom ash.

3. A method as claimed in claim 1, wherein said carbon material is coal, coke or carbide.

4. A method as claimed in claim 1, wherein said coating-use carbon material is coal, coke or carbide.

5. A method as claimed in claim 1, wherein said carbon material and said coating-use carbon material are used in a total amount of 2 to 5 times the stoichiometric, based on the amount of said alumina matter-containing raw material.

6. A method as claimed in claim 1, wherein said binder is hydrocarbon or heavy hydrocarbon.

7. A method as claimed in claim 1, wherein said burning of the surface-treated mixture is operated at a burning temperature within the range of 400° to 1300° C.

8. A method as claimed in claim 1, wherein said surface-treated mixture is supplied in the form of a mixture with said fuel coke into said reducing region in the reaction furnace.

9. A method as claimed in claim 1, wherein said surface-treated mixture and said fuel coke are alternately supplied into said reducing region in the reaction furnace.

10. A method as claimed in claim 1, wherein said fuel coke is charged in the reaction furnace together with a slagging agent.

11. A method as claimed in claim 1, wherein said oxygen-containing gas is oxygen or a mixture gas thereof with carbon dioxide, nitrogen gas or steam.

12. A method as claimed in claim 1, wherein said surface-treated mixture is supplied together with a slagging agent into said reducing region in the reaction furnace.

* * * * *